US005188356A

United States Patent [19]

Furr et al.

[11] Patent Number: 5,188,356

[45] Date of Patent: Feb. 23, 1993

[54] BASKETBALL SHOOTING AID DEVICE

[76] Inventors: Guy H. Furr, 215 Wood St., Apt. 242, Athens, Tex. 75751; Lonnie C. Furr, Rte. 2, Box 158, Murray, Ky. 42071

[21] Appl. No.: 591,398

[22] Filed: Oct. 1, 1990

Related U.S. Application Data

[63] Continuation-in-part of Ser. No. 428,771, Oct. 30, 1989, abandoned.

[51] Int. Cl.[5] ..... A63B 69/00; A61F 5/37

[52] U.S. Cl. ..... 273/1.5 A; 128/880

[58] Field of Search ..... 273/1.5 R, 1.5 A, 165, 273/166, 54 B; 2/DIG. 6, 16, 21, 161 A; 128/77, 81 R, 876, 880, 165, 169, 170

[56] References Cited

U.S. PATENT DOCUMENTS

| | | | |
|---|---|---|---|
| 3,063,446 | 11/1962 | Levitt | 128/81 R |
| 3,707,730 | 1/1973 | Slider | 2/161 A |
| 4,632,105 | 12/1986 | Barlow | 128/165 |
| 4,684,559 | 8/1987 | Wasko | 273/166 X |

*Primary Examiner*—Paul E. Shapiro

*Attorney, Agent, or Firm*—Harrington A. Lackey

[57] ABSTRACT

A basketball shooting aid device including an elongated tape member having a loop at one end adapted to fit over the thumb, or a finger adjacent the thumb, and being long enough to wrap around the thumb and the wrist of the weak or non-shooting hand of a basketball player, and fastener devices for securing the free end of the tape member about the wrist of the weak hand when the loop member secures the thumb in a restrained position relative to the fingers on the weak hand.

8 Claims, 2 Drawing Sheets

BASKETBALL SHOOTING AID DEVICE

CROSS-REFERENCE TO RELATED APPLICATION

This is a continuation-in-part of patent application Ser. No. 428,771, filed Oct. 30, 1989, now abandoned.

BACKGROUND OF THE INVENTION

This invention relates to a basketball shooting aid device, and more particularly to a device for restraining the thumb of the off shooting or non-shooting hand of the basketball shooter or player against movement away from the other fingers of the non-shooting hand, in order to improve his shooting accuracy.

In the accurate shooting of a basketball, the ball is held in the palm of the strong or shooting hand of the basketball player, such as the right hand of a right-handed player. With the elbow of the shooting hand vertically beneath the hand, the shooting hand is lifted or pushed upward to project the ball accurately toward the basket. During the shooting action, the non-shooting hand or weak hand, such as the left hand of a left-handed basketball player, is usually held against the side of the ball to function as a guide during the early stages of lifting or projecting the ball upward. However, during such a shooting procedure, there is a tendency of the player to extend the thumb of his weak hand away from the other fingers in order to further guide, or even assist in lifting, the ball. Such a practice has been found to interrupt the accuracy of the shot. The non-shooting hand should be used only to balance the ball, and the entire non-shooting hand, including the thumb, should be released or removed from the ball during its early stages of projection.

In order to overcome the tendency to release the off-hand thumb too late, the basketball player must be constantly aware of this tendency and practice to avoid such practice, and/or the coach must direct his attention to the objectionable "thumbing" practice.

The only mechanical aid known to the Applicant for remedying this "thumbing" problem, is a shooting aid known as "PURE SHOT", which is commercially available, and which includes a rigid disc having an outer surface adapted to engage the ball during the shot, and an inner surface having an adjustable strap for securing the non-shooting hand against the inner surface of the disc. In the utilization of the "PURE-SHOT", there is no contact between the non-shooting hand of the player and the ball at any time, because the hand is completely separated from the ball by the disc.

Other basketball shooting or handling aids known to the Applicant, are disclosed in the following U.S. patents:

| | | |
|---|---|---|
| 3,640,532 | Bauer | Feb. 8, 1972 |
| 3,707,730 | Slider | Jan. 2, 1973 |
| 4,377,284 | Okerlin | Mar. 22, 1983 |
| 4,383,685 | Bishop | May 17, 1983 |

None of the above devices are constructed to restrain the thumb of the weak hand from engaging the basketball.

The Slider U.S. Pat. No. 3,707,730 discloses a basketball practice glove for use on the shooting hand of the basketball player, as opposed to the non-shooting hand. The glove covers all the hand except the tips of the fingers and the thumb. The glove is assisted in assuming a cupped position, so that only the fingers and thumbs of the shooting hand will touch the ball during the shooting operation. This cup-shaped position is sustained by a short finger strap looped about the thumb and extending only to and about the forefinger where it is attached by VELCRO fasteners. However, the Slider device is a glove, as opposed to a single elongated tape member having a loop at one end and VELCRO fasteners at the opposite end, and is certainly not used in restraining or immobilizing the thumb relative to the forefinger or any of the other fingers of the non-shooting hand of the basketball player. The Slider glove incorporates many superfluous elements unnecessary to the restraint of the thumb of the weak hand, and in fact, impairs the full use of the other fingers and the rest of the weak hand for other basketball functions, as well as for comfort.

The Eisenberg U.S. Pat. No. 4,787,376, issued Nov. 29, 1988, for "RETAINER FOR GLOVE" discloses a thumb pocket attached to a glove and secured by a strap to the wrist of the glove, in which the thumb pocket is articulated in order to receive and protect the thumb to prevent damage to certain ligaments of the thumb. The purpose of the Eisenberg device is to prevent the thumb from being bent away from the other fingers, such bending causing a stretching of the ulnar collateral ligament, and to prevent the ligament from rupturing. The Eisenberg thumb pocket is made of rigid material having one piece which is hinged to prevent normal function of the thumb joint. The Eisenberg thumb retainer for a glove could not successfully function in restraining the thumb of the weak hand of a basketball player and still permit the weak hand to perform its other normal functions of the basketball player.

The Wasko U.S. Pat. No. 4,684,559 for "HAND IMPLEMENT SUPPORT APPARATUS" issued Aug. 4, 1987, discloses an elongated, large tape member having a loop member at one end and VELCRO fasteners on opposite sides of the opposite end for use in supporting the wrist of a tennis player about the racket handle, by wrapping the wrist loosely about the racket handle. Moreover, and very functionally important for the operation of the Wasko device is the fact that the tape material is not only flexible, but must be resilient and elastic, in order to successfully carry out the function of the device. It is emphasized in col. 2, lines 35–37 that the flexible band is woven or knitted fabric having an elasticized loop of a size to receive and firmly grip the butt end of a racket handle. The wrapped band thus supplements the grip of the user on the racket handle by providing additional support while absorbing a portion of the reaction forces encountered in striking the tennis ball.

In col 3, lines 41–49 of the Wasko patent, the webb 12 is defined as having a loop of elastic material such as a length of rubberized elastic. In lines 50–53, it is stated that the loop material is elasticized because it must be stretched significantly to pass over the butt end of the racket handle.

The Wasko webb not only provides a support for the wrist, bust must also facilitate maneuvering to a variety of orientations, including frequent re-positioning of the racket for different grips by the user for forehand and backhand shots, (Col. 1, 11. 55–59; Col. 2, 11. 9–13).

The only sports implement referred to in the Wasko patent for use with the elastic support webb are sports rackets for tennis, squash, racketball, badminton, paddle tennis, or deck tennis, only.

The device disclosed in the Wasko U.S. Pat. No. 4,684,559, because of this highly elasticized material used in the webb material, would fail to adequately restrain and confine the thumb of the weak hand of a basketball player against lateral movement away from the other fingers.

SUMMARY OF THE INVENTION

The basketball shooting aid device made in accordance with this invention is designed to restrain the weak, non-shooting or off hand of the basketball player during the act of shooting the ball, by confining the thumb of the weak hand to a position proximate to the other fingers of the hand.

The basketball shooting aid device made in accordance with this invention includes an elongated tape member having a loop adapted to be fitted and received about the thumb of the weak hand of the basketball player, with the remaining portion of the tape member being long enough to be wrapped about the hand and wrist of the weak hand, and provided with cooperating fastener members in order to secure the thumb in a restrained position.

More specifically, the basketball shooting aid device includes an elongated unitary tape member having a loop member at one end adapted to fit over the thumb or forefinger of the non-shooting hand, a fastener device on the outside surface of the tape member, and a cooperating fastener member on the opposite or inside surface at the opposite end portion of the tape member to permit the tape member to be wrapped about the back of the non-shooting hand and secured around the wrist of the player to confine or restrain the thumb in an operative position.

Another object of this invention is to provide an elongated unitary tape member of a totally inelastic or inextensible material having a loop member at one end, made of the same inelastic or inextensible material, which is adapted to fit over the thumb or forefinger of the non-shooting hand, with cooperating fastener members at the opposite end of the tape, and with sufficient length for the intermediate portion of the tape member to wrap about the back of the non-shooting hand and for securement around the wrist of the player to totally immobilize the movement of the thumb laterally away from the forefinger or other fingers, so that there will be no interference with the thumb of the off-shooting hand and the basketball during the shot process.

By restraining the thumb of the non-shooting or off hand with the device made in accordance. with this invention, the thumb of the off hand will not interfere with the basketball as it is being projected upward and forward by the shooting hand of the player, yet the off hand will be permitted to touch the ball sufficiently to guide and balance the ball in its initial shooting stage.

DESCRIPTION OF THE PREFERRED EMBODIMENTS

Figure 1:
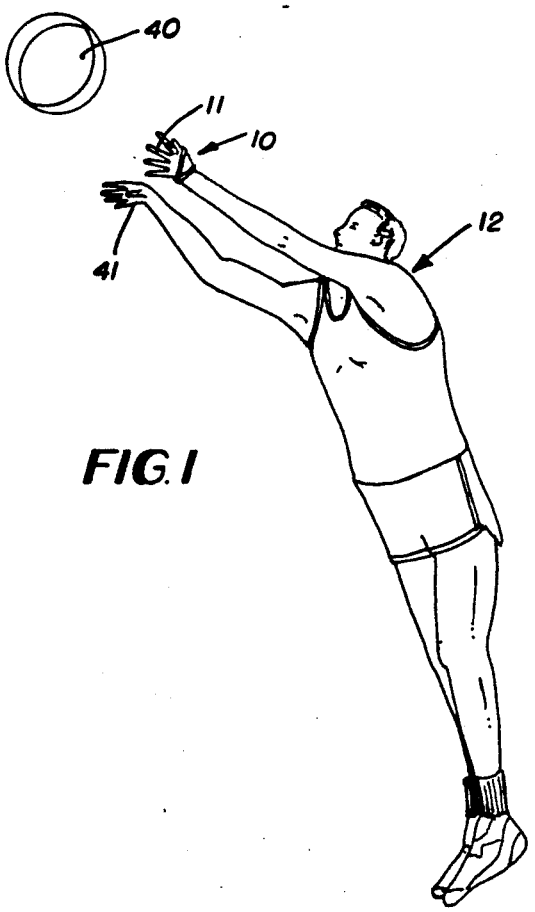
FIG. 1 is a side elevation of a basketball player wearing the shooting aid device about his left or non-shooting hand, while shooting the basketball, the loop being fitted over the forefinger.

Referring now to the drawings in more detail, FIGS. 1, 2, 5, 6, and 7 disclose a basketball shooting aid device 10 made in accordance with this invention mounted upon the non-shooting, weak hand 11 of a basketball player 12. In this case, the non-shooting or weak hand 11 is the left hand of the right-handed basketball player 12 disclosed in FIG. 1. In the drawings, the weak hand 11 is disclosed as having a back surface 13 (FIGS. 5 and 7), a palm 14 (FIG. 6), a thumb 15, a forefinger 16, and the other three fingers 17. The wrist 18 is also disclosed at the base of the hand 11.

The basketball shooting aid device 10 made in accordance with this invention includes an elongated tape 20 of an inelastic or inextensible material, and preferably a totally inelastic or inextensible material, having a first end portion 21, a second end portion 22, an intermediate portion 23, an outer surface 24, and an inner surface 25.

Figure 3:
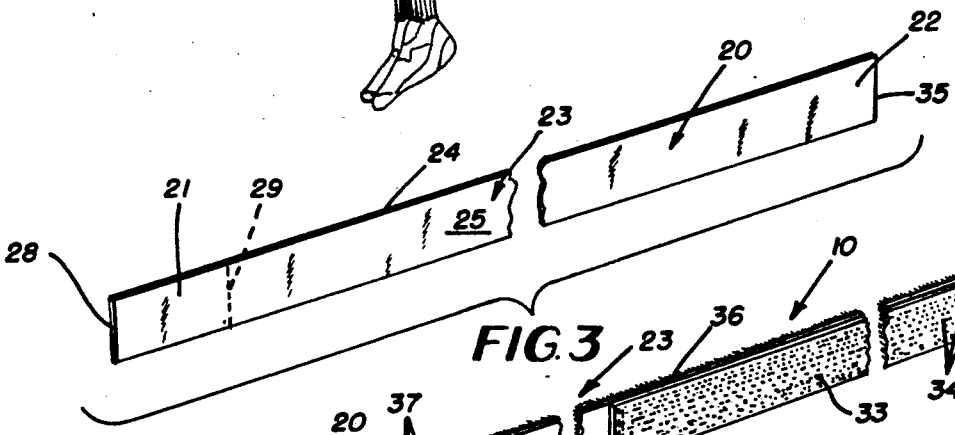
FIG. 3 is a side perspective view of the elongated tape used in the construction of the shooting aid device, with portions broken away.

In order to form a tape member 26, having a loop member 27 formed in the first end portion 21, the first end 28 of the tape 20 is folded upon itself about a fold line 29 (FIG. 3), which preferably is about two inches from the first end 28. After the first end 28 is folded upon itself, it is fixed upon the adjacent and abutting inner surface 25 of the tape 20 by means of a transverse line of stitching 30 to form a closed loop 31 having an opening 32 large enough to freely receive only a digital extremity, namely, any of the fingers 16 and 17 or the thumb 15, of the non-shooting hand 11.

Fixedly secured to the inner surface 25 of the tape member 26 adjacent the second end portion 22 is a first fastener device 33, such as an elongated strip of filament loops or loop pile 34. Preferably, the first fastener strip 33 terminates with the free end 35 of the tape member 26.

Fixedly mounted or formed on the outer surface 24 of the intermediate portion 23 of the tape member 26 is a second fastener device 36 adapted to cooperate with the first fastener device 33. Preferably, the second fastener device 36 includes an elongated strip of filament hook members 37 adapted to intermingle with and catch the loops in the loop pile surface 34. The filament loop pile surface 34 and the hook pile surface 37 may be cooperative fastener elements known in the trade as "VELCRO".

Figure 4:
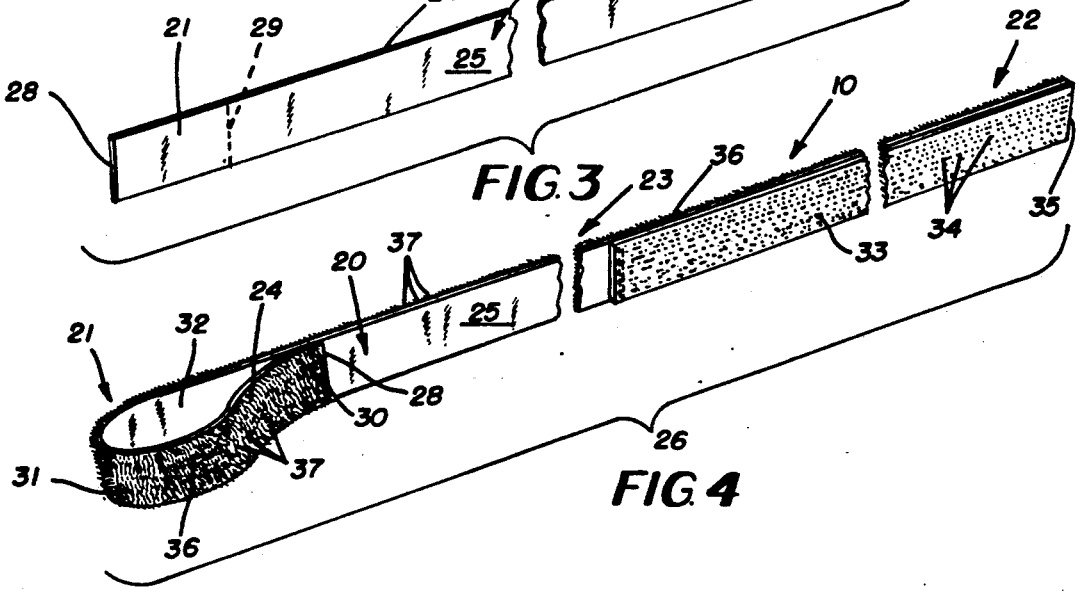
FIG. 4 is a side perspective view of the shooting aid device in an extended inoperative position, with portions broken away.

Although the second fastener device 36 is disclosed extending the entire length of the tape 20 in FIG. 4, nevertheless it must be long enough to occupy positions in which it overlaps and engages the loop pile surface 34 when the tape member 26 is in its operative wrapped position.

Figure 5:
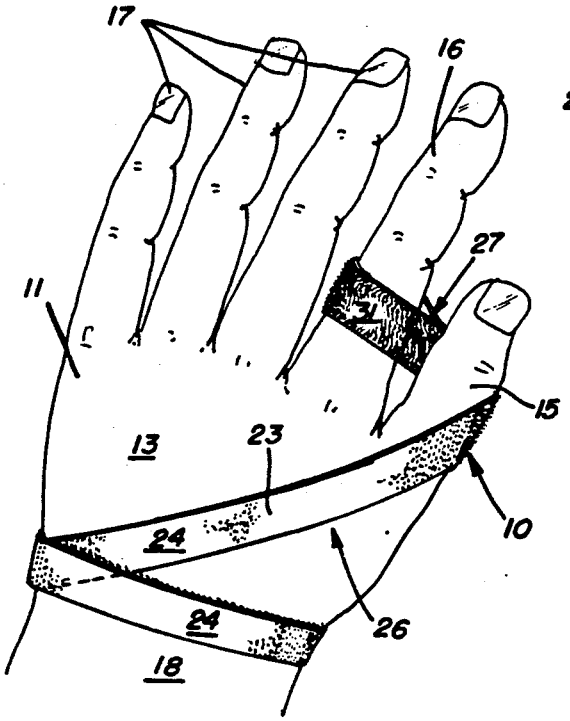
FIG. 5 is a view of the back of the non-shooting left hand of the basketball player, upon which the shooting aid device has been secured in its operative position, with the loop fitted over the forefinger, and the adjacent portion of the tape member looped around the thumb.
Figure 6:
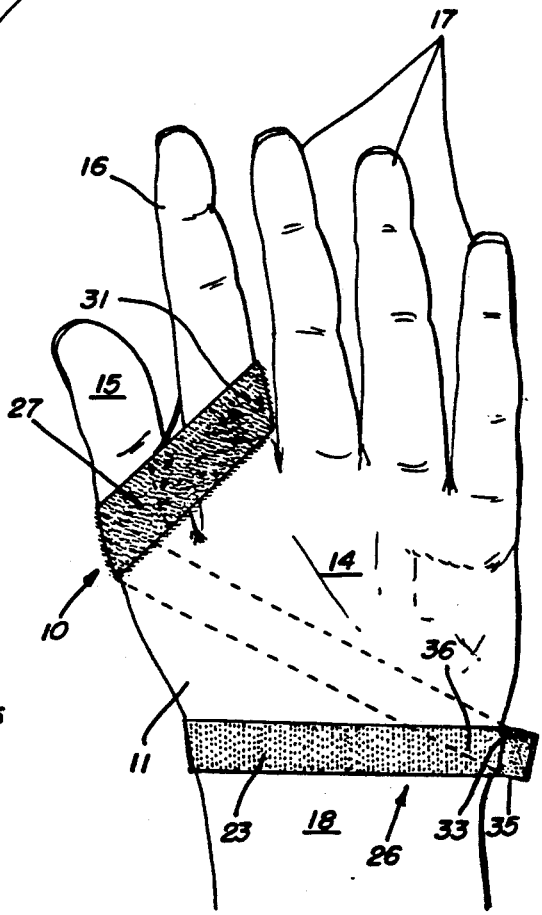
FIG. 6 is a front view of the non-shooting left hand with the shooting aid device mounted, as disclosed in FIG. 5.

The length of the tape member 26 is great enough that when the loop 31 is received over the forefinger 16, as illustrated in FIG. 5, the remainder of the tape member 26 may be wrapped around the thumb 15 to form the loop member 27 and across the back surface 13 of the weak hand 11, then around the front of the hand adjacent the wrist 18 and back cross the back of the wrist until the first fastener strip or device 33 overlies and cooperates with the second fastener device 36, as best disclosed in FIGS. 5 and 6. The tape member 26 could of course be longer, if it is desired to wrap the tape member 26 several times about the wrist.

Figure 7:
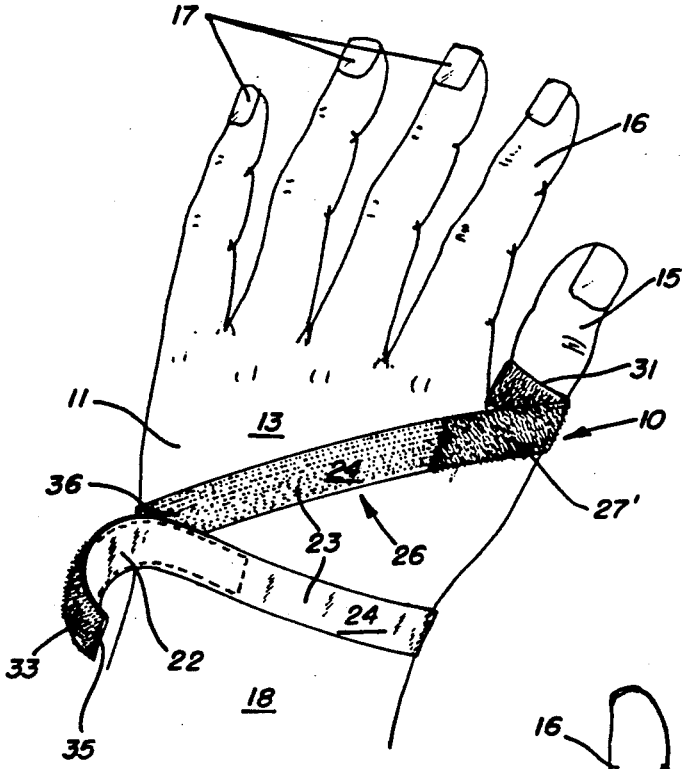
FIG. 7 is a view similar to FIG. 5 of the shooting aid device in its operative secured position, illustrating the loop fitted over the thumb of the non-shooting left hand.

In an alternative method of mounting the device 10 upon the weak hand 11, as shown in FIG. 7, the loop 31 may be slipped over the thumb 15 to form the loop member 27, and the remaining portion of the tape member 26 is wrapped about the back 13 of the hand 11 and thence around the wrist 18, and secured in the same manner as the tape member 26 is secured in FIG. 5. In this case, the tape member 26 may be slightly shorter than it would be when the loop 31 is slipped over the forefinger 16 in order to form the loop member 27.

Figure 2:
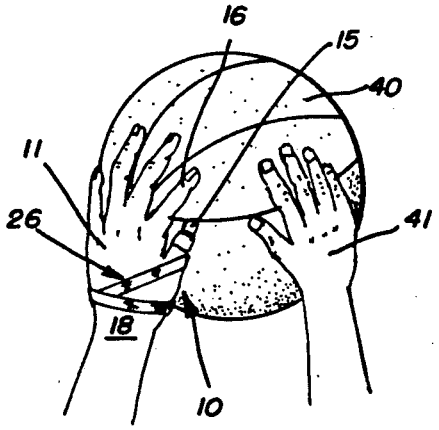
FIG. 2 is an enlarged perspective view of the basketball player's hands holding the basketball preparatory for shooting, while wearing the shooting aid device on the left or non-shooting hand, with the loop being fitted over the thumb.

After the loop 31 is fitted over the forefinger 16 or the thumb 15, the inextensible tape member 26 is drawn tightly to pull the thumb 15 to a desired position proximate to the forefinger 16 so that the thumb 15 will be restrained and confined against lateral movement away from the other fingers, when the weak hand 11 is used in guiding the basketball 40 as the basketball 40 is being shot by the shooting or strong hand 41, which is the right hand illustrated in FIGS. 1 and 2. After the thumb 15 is pulled in to its desired confined position, the tape member 26 is drawn tightly across the back 13 of the hand 11 and around the wrist 18 and then secured in its operative position by the fastener strips 33 and 36. Thus, before the thumb 15 can move laterally outward to an undesired position away from the forefinger 16, the thumb 15 will be restrained or immobilized against such movement by the tape member 26.

In the mounting procedure of the tape member 26 disclosed in FIGS. 5 and 6, the loop 31 per se is fitted around the forefinger 16, but the adjacent portion of the tape member 26 forms an open loop 27 about the thumb 15 before the intermediate portion 23 of the tape extends around the back 13 of the hand 11. In FIG. 7, the loop 31 itself forms the loop member 27' fitting directly over the thumb 15.

It will be noted, particularly in FIG. 6, that the device 10 does not interfere with other functions of the weak hand 11, such as in dribbling. The palm 14 of the weak hand 11 is completely exposed, as illustrated in FIG. 2, so that it may come in direct contact with the basketball 40. Moreover, when the device 10 is in its operative position as disclosed in FIG. 7, only the thumb 15 is confined, but all of the remaining fingers 16 and 17 are completely free to touch and feel the basketball 40, in shooting, passing, or dribbling.

Accordingly, a basketball shooting device 10 has been developed which is not only effective in restraining, confining and immobilizing the thumb 15 of the weak hand 11 during the shooting procedure, but also does not interfere with the function of the rest of the weak hand, and even the thumb 15, to some degree, in the other basketball handling procedures, such as passing and dribbling.

Furthermore, the device 10 is of simple and inexpensive construction, and is lightweight. Moreover, the device 10 is easily and quickly mounted upon the weak hand 11 with a minimum of effort, and may be just as easily and quickly adjusted to change the position of the thumb 15 if it is desired.

It will also be understood, that the device 10 can be assembled and mounted upon the right hand of a basketball player, if the right hand is the weak hand of a left-handed basketball player. The operation of mounting the device 10 upon the right hand is identical to the operation of mounting the device upon the left hand.

From the above description of the basketball shooting device 10, it will be apparent that a player wearing this device will not need to concentrate upon willfully holding his thumb in a position close to the other fingers while he is shooting, which is distracting. Moreover, the player's coach may spend less time in observing and correcting the "thumbing" error of the player, since the device itself will overcome this harmful tendency, or bad habit.

In using the shooting aid device 10, a basketball player 12 will develop in his shot, a better backspin, a higher release point and an improvement in the grip upon the ball with both the strong and the weak hand. Furthermore, the elbow of the strong arm will tend to stay vertically beneath the ball during the shooting when the device 10 is used. The use of the device 10 will also strengthen the muscles in the wrist and arm of the strong hand and the player is freer to work within his natural shooting range. Moreover, the player's follow-through in his shooting will improve.

Another advantage of the shooting aid device 10 is that it may be made from any type of inelastic or inextensible textile fabric, or even plastics which will form a loop member 27 or 27' capable of restraining the thumb 15 against lateral movement from the forefinger 16 or other fingers, so that there will be no hard or rigid parts which might tend to injure the player.

What is claimed is:

1. A basketball shooting aid device adapted to be worn on the weak, non-shooting hand of a basketball player, the non-shooting hand having digital extremities, namely, a thumb and a plurality of fingers, including a forefinger, comprising:

(a) an elongated tape member having a first end portion, an opposite second end portion, an intermediate portion between the first and second end portions, an outer surface and an inner surface, (b) said first end portion comprising a loop member large enough to receive the thumb of the weak hand of a basketball player, (c) said tape member being long enough to wrap around the wrist of the weak hand of a basketball player when said loop member receives the thumb of said weak hand, in an operative confined position proximate to the adjacent forefinger, (d) said tape member being made of an inextensible material causing said loop member to immobilize said thumb against lateral movement away from said forefinger in said operative confined position, (e) a first fastener device on said second end portion, (f) a second fastener device on said intermediate portion, and (g) said first fastener device cooperating with said second fastener device to secure said second end portion to said intermediate portion in said operative confined position.

2. The invention according to claim 1 in which one of said first or second fastener devices comprises a filament hook type fastener and the other of said second or first fastener devices comprises a filament loop type fastener.

3. The invention according to claim 2 in which said first fastener device is on said inner surface and said second fastener device is on said outer surface.

4. The invention according to claim 2 in which said first and second fastener devices comprises elongated strips of said loop filaments and said hook filaments respectively, said strip of said first fastener device being longitudinally spaced from said loop member and at least a portion of the strip of said second fastener device being spaced longitudinally between said loop member and said first fastener device strip.

5. The invention according to claim 4 in which said second end portion has a free second end and said strip of said first fastener device terminates in said second end.

6. The invention according to claim 1 in which said loop member comprises a closed loop formed by a folded portion of said first end portion secured upon itself and large enough to receive and encircle the thumb of said weak hand.

7. The invention according to claim 6 further comprising stitching for securing said first end portion upon itself to form said loop.

8. The invention according to claim 1 in which said loop member comprises a loop formed in said first end portion having an opening large enough to receive therethrough only a digital extremity of the weak hand, and an adjacent strip of said first end portion adjacent said loop adapted to loop around said thumb in said operative confined position, when said loop receives a finger of said weak hand, whereby said thumb is immobilized against movement away from the fingers of said weak hand.

* * * * *